US005909021A

United States Patent [19]

Duffy

[11] Patent Number: 5,909,021

[45] Date of Patent: Jun. 1, 1999

[54] KEYPADS: APPARATUS AND METHODS OF MAKING

[75] Inventor: Patrick Duffy, Stirling, United Kingdom

[73] Assignee: The SAS Group, LLC, Chicago, Ill.

[21] Appl. No.: 09/081,741

[22] Filed: May 19, 1998

Related U.S. Application Data

[ 60] Provisional application No. 60/056,362, Aug. 19, 1997.

[51] Int. Cl.[6] ..... H01H 13/70; H01H 9/18

[52] U.S. Cl. ..... 200/514; 29/622

[58] Field of Search ..... 29/622; 200/511, 200/512, 514, 308, 341, 5 A; 400/490, 491, 494

[56] References Cited

U.S. PATENT DOCUMENTS

| | | | |
|---|---|---|---|
| 5,399,821 | 3/1995 | Inagaki et al. | 200/341 |
| 5,475,192 | 12/1995 | Inagaki et al. | 200/341 |
| 5,589,121 | 12/1996 | Inagaki et al. | 264/132 |
| 5,613,599 | 3/1997 | Inagaki et al. | 200/512 |
| 5,807,002 | 9/1998 | Tsai | 400/494 |

FOREIGN PATENT DOCUMENTS 0 737 992 A1 10/1996 European Pat. Off. ..... H01H 13/70

OTHER PUBLICATIONS

M. Laurin, In–Mold Decoration, GE Plastics, Structured Products, Apr. 14, 1997.

*Primary Examiner*—Michael A. Friedhofer
*Attorney, Agent, or Firm*—Bell, Boyd & Lloyd

[57] ABSTRACT

The keypad is made of a) a formed plastic shell; b) graphics and background printed on the interior surface of the formed plastic shell; and c) a plastic filling the hollow cavity or cavities of the formed plastic shell. The formed plastic shell of the keypad is a polycarbonate and the plastic filling the hollow cavities is a thermoplastic resin or an elastomer. Additionally, the background printed on the interior surface of the formed plastic shell is made with a flexible ink and the keypad has a wear resistance test score in a Norman tester of greater than 40 cycles before the ink on the keypad fails on abrasion testing.

21 Claims, 2 Drawing Sheets

Fig. 1
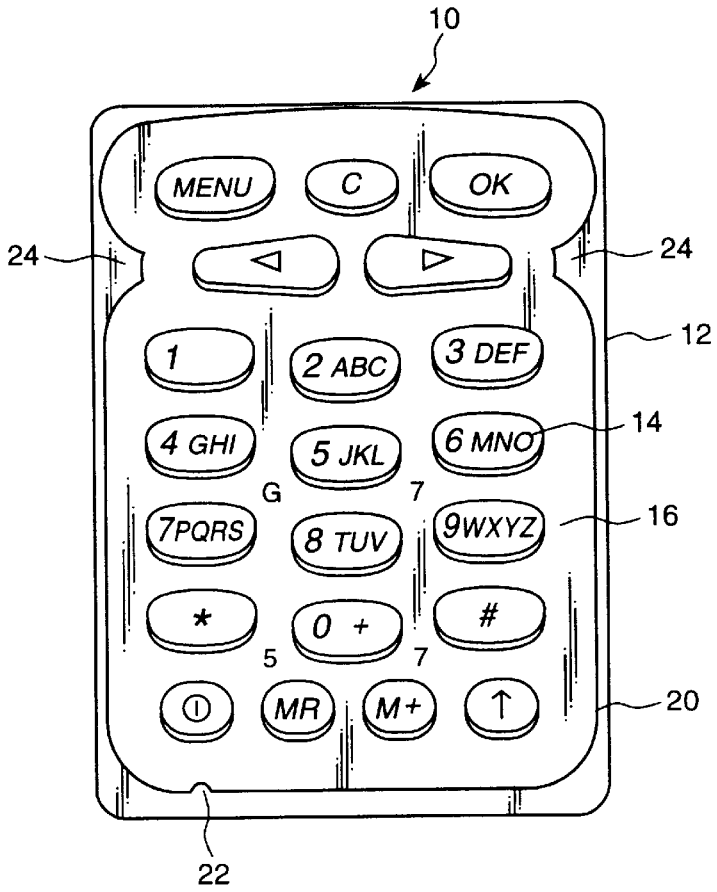
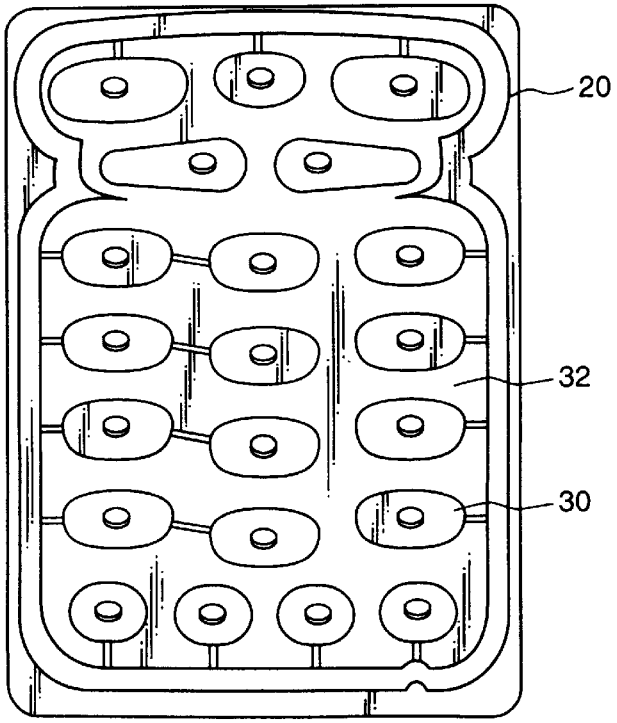
Fig. 2

KEYPADS: APPARATUS AND METHODS OF MAKING

This patent application claims is related to U.S. Provisional Patent Application 60/056,362, filed Aug. 19, 1997, the entire contents of which are hereby incorporated by reference and relied upon.

BACKGROUND OF THE INVENTION

1. Field of the Invention

The present invention discloses a plastic keypad and a process for the manufacture of the plastic keypad. The keypad is made of a) a formed plastic shell, b) graphics printed on the interior surface of the formed plastic shell; and c) a plastic filling the hollow cavity or cavities of the formed plastic shell. The formed plastic shell of the keypad is a polycarbonate and the plastic filling the hollow cavities is a thermoplastic resin or an elastomer. Additionally, the background printed on the interior surface of the formed plastic shell is made with a flexible ink and the keypad has a wear resistance rating in a Norman tester of greater than 40 cycles before the ink on the keypad fails on abrasion testing.

The process for the manufacture of the plastic keypad comprises a) second surface printing of graphics and background onto a flat plastic sheet, where ultraviolet-light curable inks are used for the printing of the graphics and flexible inks are used for the printing of the background; b) forming the flat plastic sheet into a formed keypad, where the formed keypad has at least one button having a hollow cavity on an interior surface; c) filling the interior surface of the hollow cavity with a plastic; and d) trimming or profiling the formed keypad to the specifications of the manufacturer. The flat plastic sheet is a polycarbonate and the plastic used to fill the interior surface of the hollow cavity is a thermoplastic resin or an elastomer.

2. Description of the Related Art

Keypads for data input devices e.g., telephones, calculators, computers, typewriters, etc., currently take on several forms. They may be constructed of plastic, silicon, rubber, or silicon rubber and can be in the form of "tree keypads" or one single unit known as "mat keypads". The graphics, e.g., numbers, letters, symbols, etc., are generally screened printed onto the keypad after it is formed. In relation to the silicone rubber "mat keypads", the ink used in the screened printing is a silicone ink. However, silicone ink only prints onto silicone and will not print onto plastic e.g., polycarbonate.

A major manufacturer of data input devices recently issued a request for companies to come up with a keypad for mobile phones that was primarily constructed of plastic rather than silicone rubber. A keypad constructed of plastic would reduce the cost of producing the keypad. The key specification of the new keypad was that it must withstand a wear resistance test in a Norman tester of 40 cycles before the ink on the keypad failed on abrasion testing.

The immediate problem with this request was that if the ink was on the top of the plastics then the ink would not withstand the Norman tester requirements as the ink would flake and wear quickly. The present inventor had intimate knowledge of silicone keypads and the Norman tester. It was, therefore, decided that to avoid the problems associated with using first surface print, i.e., the ink on the surface of the plastic, and that second surface print techniques should be used.

Second surface print is the process whereby the print is put onto the underside of the plastic sheet and not on the tops i.e., the print is viewed through the sheet rather than on top of it. The use of second surface print avoids the abrasion problems as the ink does not come into contact with anything in use.

Second surface print would be onto a flat sheet. The flat sheet would then have to be distorted or formed in order to create an acceptable keypad with raised keys. In order to align the art work correctly, manipulation and distortion techniques would be used so that the graphics would appear correctly onto the keys in question.

The second more pressing problem was that conventional ink will not stretch. Distortion of the plastic sheet would lead to pin holing whereby gaps appear in the ink. Therefore, a more flexible ink was needed.

Personnel from GE Plastics, Structured Products, have produced a document entitled "In-Mold Decoration", M. Laurin, Apr. 14, 1997, the entire contents of which are hereby incorporated by reference and relied upon. This document gives a very good background into the technology available prior to the work of the present inventor (see, for example, page entitled "Ink Selection"). Researchers at GE Plastics were asked at a seminar in America whether it was possible to produce such a flexible ink for the use required by the present inventor. The GE Plastics document lists that there are very few suitable inks for second surface decoration and there were a few companies which specialized in ink that would adhere to a flexible polycarbonate. However, no one had an ink suitable for second surface decoration to satisfy the needs for the keypads of the present invention.

After extensive experimentation, the present inventor discovered the plastics, ink, and process necessary to create a plastic keypad capable of withstanding a wear resistance test in a Norman tester of 40 cycles before the ink on the keypad failed abrasion testing requirements. The resulting keypad and method for its manufacture are the subject of the present application and more fully described below.

SUMMARY OF THE INVENTION

The present invention discloses a plastic keypad and a process for the manufacture of the plastic keypad. The keypad is made of:

a) a formed plastic shell having exterior and interior surfaces, where the formed plastic shell has at least one button having a hollow cavity on an interior surface;

b) graphics printed on the interior surface of the formed plastic shell;

c) background printed over the graphics on the interior surface of the formed plastic shell; and d) a plastic filling the hollow cavity of the at least one button of the formed plastic shell.

The formed plastic shell of the keypad is a polycarbonate and the plastic filling the hollow cavity of the button or buttons of the formed plastic shell is a thermoplastic resin, preferably a polycarbonate or a styrene-butadiene copolymer, or an elastomer, preferably a silicone.

Additionally, the graphics printed on the interior surface of the formed plastic shell comprises an ultraviolet-light cured ink, the background comprises a flexible ink, and the keypad has a wear resistance test score in a Norman tester of greater than 40 cycles before the ink on the keypad fails on abrasion testing. In a preferred embodiment, the keypad also includes a light flood coat printed over the background on the interior surface of the formed plastic shell. The light flood coat also comprises a flexible ink.

The process for the manufacture of the plastic keypad comprises the following steps:

a) second surface printing of graphics onto a flat plastic sheet with an ultraviolet-light curable ink;

b) second surface printing of background over the graphics with a flexible ink;

c) forming the flat plastic sheet into a formed keypad having exterior and interior surfaces, wherein the formed keypad has at least one button having a hollow cavity on an interior surface;

d) filling the interior surface of the hollow cavity with a plastic; and e) trimming the formed keypad.

In the present method, the flat plastic sheet is a polycarbonate and the plastic used to fill the interior surface of the hollow cavity is a thermoplastic resin, preferably a polycarbonate or a styrene-butadiene copolymer, or an elastomer, preferably a silicone.

In a preferred embodiment, the second surface printing step further includes the printing of a light flood coat over the background with a flexible inks Furthermore, the forming step can be either a vacuum forming step, an air forming step, or a match metal step.

Additionally, the present method may further comprise applying manipulation and distortion techniques to the flexible ink or inks. Finally, plastic injection molding techniques may be used to fill the interior surface of the hollow cavity with a plastic.

BRIEF DESCRIPTION OF THE DRAWINGS

FIG. 1 shows a frontal view of a keypad of the present invention made for a portable telephone. With this view the polycarbonate sheet 12, the graphics 14, the background 16, and a slot 22 and indentations 24 on the trimmed outer periphery 20 of the finished keypad 10 can be seen.

FIG. 2 shows a rear view of the completed keypad with the filled interior surface of the hollow cavities. With this view the thermoplastic resin 30, the light flood coat 32, and the trimmed outer periphery of the finished keypad 10 can be seen.

DETAILED DESCRIPTION OF THE PREFERRED EMBODIMENT

A. Second Surface Printing

Figure 3:
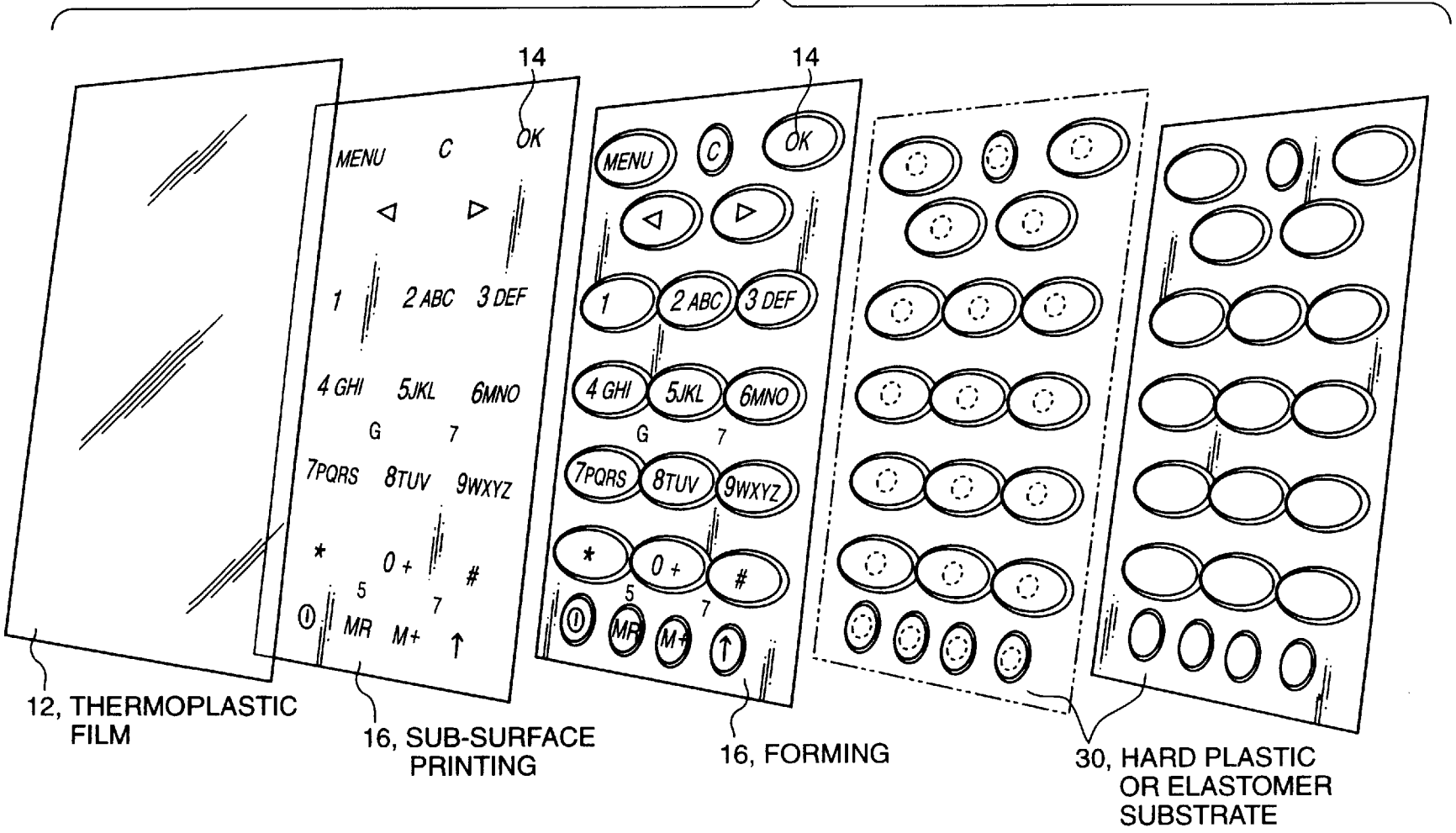
FIG. 3 shows a composite of the plastic keypad and the method for the manufacture of the plastic keypad of the present invention. Construction of the keypad involves second surface printing on a thermoplastic film 12, followed by high pressure air forming. The material back fill can be either a hard plastic or softer elastomer to suit the feel of the user. Four operation steps are used in the method for the manufacture of the plastic keypad of the present invention, i.e., printing forming filling or injection molding and trimming. This Figure does not show the trimming step. The resultant product following the trimming step is seen in FIG. 1.

Second surface printing is the process whereby print is placed on the underside or second surface of a plastic sheet and not on the top or first surface, i.e. the print is viewed through the sheet rather than on top of it. The use of second surface printing avoids abrasion problems as the ink does not come into contact with anything in use.

In the initial process step of the present invention, second surface print is produced by first printing graphics onto a flat plastic sheet with an ultraviolet-light curable ink. This ink is used to stabilize the graphics. The ink is fast cured and fully cured under ultraviolet lights.

Then a background coat or black flood coat is printed over the graphics onto the plastic sheet with a flexible ink. The flexible ink is a solvent based ink. The reason for using a solvent based ink is that it can be made to stretch by controlling the amount of catalyst that is added to the ink. If a full amount of catalyst is used, the ink will fully cure and become inflexible. However, if less than a full amount of catalyst is used, the ink will not fully cure and become the desired flexible ink of the present invention.

More specifically, graphics are first printed onto a polycarbonate sheet with an IMD series ultraviolet-light curable ink manufactured by Nor-Cote International, Inc., Crawfordsville, Ind. All IMD series ultraviolet-light curable ink contain acrylated oligomers (20–55 wt %), N-vinyl-2-pyrrolidone (12–25 wt %), and acrylated monomers (8–20 wt %). In addition, the following ingredient is contained in the 4X Black IMD series ultraviolet light curable ink: N-vinylcaprolactam (16–19 wt %)—a mixture of 2H-azepin-2-one, 1 etheny (98.5% wt %) and 2H-azepin-2-one, hexahydr (1.5 wt %).

A background is then printed over the graphics onto the plastic sheet with a flexible ink. The flexible inks used in the present invention are solvent based inks. Examples of solvent based inks include the Noriphan® HTR series of solvent based inks manufactured by Farbenfabrik Proll GmbH & Co., Weissenburg 1. Bay, Germany. The Noriphan® HTR series of solvent based white paint includes mesitylene (less than 2.5 wt. %), technical diacetone alcohol (2.5–10 wt %), 2-methoxy-1-methylethyl acetate (10–25 wt %), 1,2,4-trimethylbenzene (2.5–10 wt. %) and naphtha solvent (2.5–10 wt. %).

Optionally, a third layer, a light flood coat, may be second surface printed over the graphics and background. The light flood coat is printed with a light colored flexible ink and is used to facilitate the transmission of light through the button or buttons of the resultant keypad. The flexible inks used to print the light flood coat are identical to the solvent based, flexible inks used to print the background except for the lighter color of the inks. Examples of solvent based inks used for the light flood coat include the Noriphan® HTR series of solvent based inks manufactured by Farbenfabrik Proll GmbH & Co. and the IMD 3060 409 49 00 series of solvent based inks manufactured by Nor-Cote Internationals Inc. The IMD 3060 409 49 00 series of solvent based inks include N-methyl-2-pyrrolidone (15–20 wt %), 2-methoxy-1-methylethyl acetate (35–40 wt. %) and naphtha solvent (15–20 wt. %).

In this process steps the ultraviolet-light curable inks and the flexible inks of the present invention are compatible with the polycarbonate films. In other words, the ultraviolet-light curable inks and the flexible inks can be printed onto the polycarbonate films.

The second surface printing step ensures that the operator of the resultant keypad never makes contact with the ink and that the ink on the keypad never degrades in color because of abrasion or wear. However, second surface printing increases the complexity of the manufacturing process. The transfer technology is difficult to master and requires that the printer have knowledge of the injection molding process.

If the manufacturer of the keypad is not concerned with ink wear or color degradation because of abrasion, top printing is an option to the more complex and costly second printing technique. In addition, top printing may be suitable for products that do not require to be back lit. However, top printing is not included within the scope of the present invention.

B. Forming of Plastic Keypad

Forming is the process of converting a flat plastic sheet into a keypad shape. The flat sheet is distorted or formed in order to create an acceptable keypad with raised keys. In order to align the art work correctly, manipulation and distortion techniques are used so that the graphics appear correctly on the finished keys in question. This formed keypad creates the buttons of the pad with a hollow cavity on the interior surface. These hollow keypads are then filled using injection molding techniques to create the finished keypad (see FIG. 3).

In this step of the process, polycarbonate film is preheated to create flexibility and then subjected to high pressure air. The high pressure air forces the film into a mold cavity, thereby creating the desired shape of the keypad.

The forming of the film is currently done by what is known as vacuum or air forming (see GE document "In Mold Decorating", page entitled "Film Forming Options"). The polycarbonate film is heated and then either sucked (vacuum) or pushed (air) into the relevant shapes of parts. Vacuum forming is a technique in which film is pulled into the mold or cavity by the force created by a vacuum. The technique is limited in the depth or height of key shape attainable. In contrast, air forming is the technique in which film is pushed into the mold or cavity by the force created by hot air. The air forming technique allows the formation of key shapes having greater depth or height.

The air forming machine currently in use by the present inventor was purchased in order to specifically perform the process of the present invention. Such air forming machines are expensive. Therefore, the present inventor has further developed an additional technique which overcomes the limitations imposed upon the present process by the use of an air forming machine.

Match metal is the process whereby one uses a male and a female metal former with complementary shapes between which a polycarbonate film is placed. The formers are then used to punch the keypad into shape. A tool has been constructed for this process and has been used to form the keypad. A top plate accommodates the punches to force the film into the mold shape. A bottom plate accommodates the keypad profile and heater rods to soften the film.

In other words, match metal is the process of punching a material into a desired shape. A tool is constructed with a male punch on one side which is dimensionally correct to the internal shape of a button and with a female punch on the other side which is dimensionally correct to the external shape of the button. The two sides, plates, or halves of the tool are capable of coming together within the construction of the press tool, i.e., the two plates are aligned to share pillars and brushes.

A flat polycarbonate film containing the printed graphics and background is placed between both sides of the tool. The polycarbonate film is trapped between the halves by closing the tool. The closing deforms the polycarbonate film into the shape of the punch and die, i.e., the male and females halves.

In addition, a series of heater rods can be placed on the female side of the tool. The heater rods are used to increase the temperature of the tool to approximately 100° C. and thereby further facilitate this process step.

No one would have thought of using match metal for this kind of polycarbonate sheet with surface print upon it because:

1. inks generally known in the trade are inflexible and will not take the stretching that occurs when hit with a metal punch; and 2. nobody would cold punch polycarbonate due to the lack of any technical data supporting this method of forming.

Polycarbonate is considered to be a very inflexible material and withstands forming. Furthermore polycarbonate has a memory retention capability within its structure, i.e., once formed it will try to revert back to its original shape if subjected to heat or over a period of time. This is not a concern in our process as we back fill the formed shape with a plastic material, thereby making it impossible for the polycarbonate to exercise memory.

In the match metal process, we use standard press tool techniques but we create a clearance between the punch and die in order to avoid cutting the material. Therefore, the material is pressed into shape instead of being cut into shape. The process is less expensive and uses the plastic cold rather than heating it as is necessary in the air forming process. The tool itself is inexpensive to construct. There are numerous workshops which will be able to use the tool to produce a formed plastic keypad which is then finished by injection molding.

As mentioned above, manipulation and distortion techniques are used in order to align the graphics correctly onto the keys in question. For example, after a keypad is formed, the position of the graphics on the individual buttons is measured. If a given graphic is misplaced or improperly positioned on the button, the silk screen is remade with appropriate compensation or manipulation of the improperly aligned graphic. A new keypad is made and the graphic remeasured. The process is continued until the proper position of each graphic is attained.

Likewise, after a keypad is formed, the form of each graphic on the individual buttons is measured. If a given graphic is malformed or improperly formed on the button, the silk screen is remade with appropriate compensation or distortion of the improperly formed graphic. A new keypad is made and the graphic remeasured. The process is continued until the proper form of each graphic is attained.

C. Plastic Injection Molding

Normally, when plastic injection molding is being used, the injection plastic is usually identical to the original plastic film so that the injection plastic and original plastic film will bind together. In the method of the present invention, a hard plastic resin or a soft elastomer is used to back fill the button or buttons of the formed keypad. The use of either a hard thermoplastic resin or soft elastomer back fill provides the manufacturer with an option on feel of the keypad. A hard touch or feel can be created for the product by using a hard thermoplastic resin, e.g., a polycarbonate or a styrene-butadiene copolymer, and a soft touch or feel can be created by using an elastomer, e.g., silicone (see FIG. 3).

In this process step, the thermoplastic resins and elastomers are compatible with the flexible inks of the present invention. In order words, the thermoplastic pills which form in the hollows of the polycarbonate sheet as a result of the injection molding adhere to the ink and do not fall out of the hollows.

D. Trimming

Trimming or profiling is the process step where the formed keypad is cut to its final shape from the formed sheet. This process step can also include the addition of holes, indentations, and/or slots that may be required to meet the specifications of the manufacturer. A press tool is routinely used for this final process step. However, a laser can be used for more complex trimming or profiling. In FIG. 3, the outer periphery of the formed keypad sheet is in the shape of a rectangle. In FIG. 1 the outer periphery has been trimmed to the final salt shaker bottle shape or profile.

A polycarbonate film or sheet can be used to form one or more keypads. Normally, four keypads are made from one sheet. Individual keypads must then be trimmed from the sheet. For example, a sheet containing four keypads is placed into a press tool that will cut out the four individual keypads. During this process step, it is possible to include the punching out of holes or slots that may be required for location points within the bezel of a phone or handset. Prior to this point, the keypad looks like a rectangular sheet covered with buttons (see FIG. 3). After the trimming step, the finished keypad acquires its characteristic shape (see FIG. 1).

EXAMPLE 1

The keypad of the present invention, as seen in FIG. 1, was made as follows. Graphics were printed onto a flat sheet of polycarbonate film. The polycarbonate film was purchased as Macrofol® DE from Bayer AG, Koln Germany or as Lexan® from GE Plastics, Pittsfield, Mass. The printing was performed with second surface printing in two substeps. An ultraviolet-light curable ink was used to print the graphics onto the flat sheet of polycarbonate using the IMD series ultraviolet-light curable ink manufactured by Nor-Cote International, Inc., Crawfordsville, Ind. The printed polycarbonate sheet was subjected to ultraviolet light (2×200 watt Mercury Vapor Lamps) and cured in milliseconds.

Then a flexible ink was used for the printing of the background over the graphics onto the polycarbonate sheet using Noriphan® Black (Noriphan® HTR series of solvent based inks manufactured by Farbenfabrik Proll GmbH & Co., Weissenburg 1. Bay, Germany). The Noriphan® Black solvent based ink was dried under infra-red light at 70° C. for 30 seconds.

The printed polycarbonate sheet was then heated to a temperature of 100° C. for 10 seconds and air formed into a keypad having 21 hollow cavities on the interior surface. Each cavity was filled by injection molding with Lexan® 121R polycarbonate resin manufactured by GE Plastics Sale Cheshire, United Kingdom.

The keypad was then trimmed into its characteristic salt shaker bottle shape. The resultant keypad had firm or hard buttons. A composite of the plastic keypad and the method for the manufacture of the plastic keypad of the present invention are shown in FIG. 3.

EXAMPLE 2

Another embodiment of the present invention was made as follows. Graphics were printed onto a flat sheet of polycarbonate. The polycarbonate was purchased as Mylar® from GE Plastics, Pittsfield, Mass. The printing was performed with second surface printing in three parts. An ultraviolet-light curable ink was used to print the graphics onto the flat sheet of polycarbonate using the IMD series ultraviolet-light curable ink manufactured by Nor-Cote International Inc., Crawfordsville, Ind. The printed polycarbonate sheet was subjected to ultraviolet light (2×200 watt Mercury Vapor Lamps) and cured in milliseconds.

A flexible ink was then used for the printing of the background over the graphics onto the polycarbonate sheet using Noriphan® Black (Noriphan® HTR series of solvent based inks manufactured by Farbenfabrik Proll GmbH & Co., Weissenburg 1. Bay, Germany). The Noriphan® Black solvent based ink was dried under infra-red light at 70° C. for 30 seconds.

Finally, a light colored flexible ink was used for the printing of a light flood coat over the background using Nor-Cote (FSX) solvent based ink manufactured by Nor-Cote International, Inc., Crawfordsville, Ind. This further printed sheet was dried under infra-red light for 70° C. for 30 seconds.

The printed polycarbonate sheet was then heated to 100° C. for 10 seconds and air formed into a keypad having 21 hollow cavities on the interior surface. Each cavity was filled by injection molding with Lexan® 121R polycarbonate resin manufactured by GE Plastics, Sale Cheshire, United Kingdom.

The keypad was trimmed into its characteristic bottle shape. The resultant product had hard buttons and is shown in FIG. 2.

EXAMPLE 3

A third embodiment of the present invention was made as follows. Graphics were printed onto a flat sheet of polycarbonate film The polycarbonate film was purchased as Macrofol® from Bayer AG, Koln, Germany or as Mylar® from GE Plastics, Pittsfield, Mass.

The second surface printing step and the forming step were identical to those described for Example 1 above. Each cavity was then filled by injection molding with Silastic®S49 (silicone resin supplied by Dow Corning Europe, LaHulpe Belgium) or silicone rubber (supplied by ShinEtsu, Almere the Netherlands) and filled into the cavity using standard compression mold techniques associated with manufacture of silicon rubber products.

The keypad was then trimmed into its desired shape. The resultant product was a keypad with soft buttons and was similar to that shown in FIG. 2.

E. Overcoming the Expensive Forming Process

The use of an air forming machine is not only expensive but restricts the number of places available that can be used in order to produce the required formed plastic keypad prior to injection molding. The present inventor discovered that it was possible to directly form a keypad using the injection molding system. By using split speed technology, the present inventor was able to adjust the injection molding process so that a keypad is directly formed as the resin is injected. The advantage is readily apparent. The direct formation of the keypad removes the need for a separate forming process, i.e., by air forming machines, vacuum forming machines, or by metal matching machines.

In the direct injection technique, we use a standard molding machine. The polycarbonate is inserted into the molding machine in a flat condition and held by four clamps. The press is closed and the thermoplastic resin is injected. The thermoplastic resin is first injected by low pressure to form the plastic film and to protect the ink. The resin is then injected by high pressure to fill the hollow.

More specifically, the flow rate of material with an injection molding machine can be controlled or varied to suit the part being manufactured. Some parts require a very fast first flow to cover a large thin wall area. The process can then be followed by a secondary shot of material to fill in the remaining voids.

In the present invention, graphics are first printed onto a polycarbonate sheet with an ultraviolet light cured ink as described in Examples 1–3 above. A background is then printed over the graphics onto the polycarbonate sheet with a flexible ink as described in Examples 1–3 above. The thermoplastic resins or elastomers are then injected directly onto the printed side of the polycarbonate sheet at a low speed. The thermoplastic resins or elastomers are injected at low speed in order to prevent the ink from exploding under the speed and heat of the molten plastic. The resin was injected at a speed of 60 mm per second.

The speed and heat of the molten plastic converts the printed polycarbonate sheet into a formed keypad. After the initial low speed injections a secondary shot of molten plastic is applied to complete the filing process. A speed of 88 mm per second is used to complete the filing process.

In addition, this direct injection technique, apart from reducing the overall cost of the process, provides means for manufacturing a keypad with only an injection molding machine. The availability of a greater number of potential manufacturers provides greater flexibility for the keypad manufacturing industry.

While the invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the appended claims.

Thus, it is to be understood that variations in the present invention can be made without departing from the novel aspects of this invention as defined in the claims. All patents and articles cited herein are hereby incorporated by reference in their entirety and relied upon.

What is claimed is:

1. A method for the manufacture of a plastic keypad, comprising the steps of:

a) second surface printing of graphics onto a flat plastic sheet with an ultraviolet-light curable ink;

b) second surface printing of background over the graphics with a flexible ink;

c) forming the flat plastic sheet into a formed keypad having exterior and interior surfaces, wherein the formed keypad has at least one button having a hollow cavity on an interior surface;

d) filling the interior surface of the hollow cavity with a plastic; and e) trimming the formed keypad.

2. The method of claim 1, wherein the flat plastic sheet is a polycarbonate.

3. The method of claim 2, wherein the plastic used to fill the interior surface of the hollow cavity is a thermoplastic resin or an elastomer.

4. The method of claim 3, wherein the thermoplastic resin is a polycarbonate.

5. The method of claim 3, wherein the thermoplastic resin is a styrene-butadiene copolymer.

6. The method of claim 3, wherein the elastomer is a silicone.

7. The method of claim 1, wherein said forming step comprises vacuum forming.

8. The method of claim 1, wherein said forming step comprises air forming.

9. The method of claim 1, wherein said forming step comprises a match metal step.

10. The method of claim 1, wherein the second surface printing of background step further comprises applying manipulation and distortion techniques to the flexible ink.

11. The method of claim 1, wherein plastic injection molding is-used to fill the interior surface of the hollow cavity with a plastic.

12. The method of claim 1, further comprising second surface printing of a light flood coat over the background with a flexible ink.

13. A keypad, comprising:

a) a formed plastic shell having exterior and interior surfaces, wherein said formed plastic shell has at least one button having a hollow cavity on an interior surface;

b) graphics printed on the interior surface of the formed plastic shell;

c) background printed over the graphics on the interior surface of the formed plastic shell; and d) a plastic filling the hollow cavity of the at least one button of the formed plastic shell.

14. The keypad of claim 13, wherein the formed plastic shell is a polycarbonate.

15. The keypad of claim 14, wherein the plastic filling the hollow cavity of the at least one button of the formed plastic shell is a thermoplastic resin or an elastomer.

16. The keypad of claim 15, wherein the thermoplastic resin is a polycarbonate.

17. The keypad of claim 15, wherein the thermoplastic resin is styrene-butadiene copolymer.

18. The keypad of claim 15, wherein the elastomer is a silicone.

19. The keypad of claim 13, wherein the background printed on the interior surface of the formed plastic shell comprises a flexible ink.

20. The keypad of claim 13, wherein said keypad has a wear resistance test score in a Norman tester of greater than 40 cycles before the ink on the keypad fails on abrasion testing.

21. The keypad of claim 13, further comprising a light flood coat printed over the background on the interior surface of the formed plastic shell.

* * * * *